US006006167A

United States Patent [19]

Bunting

[11] Patent Number: 6,006,167

[45] **Date of Patent: *Dec. 21, 1999**

[54] GAS BURNER MONITOR AND DIAGNOSTIC APPARATUS

[76] Inventor: John E. Bunting, 75 Scobie Rd., New Boston, N.H. 03070

[ * ] Notice: This patent is subject to a terminal disclaimer.

[21] Appl. No.: 09/039,537

[22] Filed: Mar. 16, 1998

Related U.S. Application Data

[63] Continuation-in-part of application No. 08/819,540, Mar. 17, 1997, Pat. No. 5,761,092, which is a continuation-in-part of application No. 08/637,833, Apr. 25, 1996, Pat. No. 5,612,904.

[51] Int. Cl.[6] ..... G01B 7/00

[52] U.S. Cl. ..... 702/130; 702/183; 702/185; 431/14; 431/18; 431/66

[58] Field of Search ..... 702/130, 138, 702/183, 185; 364/140, 141, 143–145, 528.16, 528.17; 431/13, 14, 18, 66

[56] References Cited

U.S. PATENT DOCUMENTS 5,005,142 4/1991 Lipchak et al. ..... 702/183
5,612,904 3/1997 Bunting ..... 702/183
5,706,191 1/1998 Bassett et al. ..... 702/130
5,761,092 6/1998 Bunting ..... 702/185

*Primary Examiner*—Marc S. Hoff
*Assistant Examiner*—Bryan Bui
*Attorney, Agent, or Firm*—William B. Ritchie; Michael J Persson

[57] ABSTRACT

A gas burner operation monitoring apparatus for enabling convenient diagnosis of gas burner and control problems. The invention is a temporarily attached device that collects and stores information concerning the key functions indicative of a gas burner's operation. If a fault occurs, the apparatus generates a signal to indicate to a downstream microprocessor, if such is connected, that a problem has occurred. This eliminates the need for the technician to randomly replace parts until the problem is located. The system monitors the status of the thermostat or aquastat; the presence and the level of voltage being sent to the main gas valve; the pressure of gas at the inlet and outlet of the main gas valve and either the temperature on the outside of the vent stack pipe or the presence and quality of flame at the main gas burner. The device also provides a signal in the event of a fault that can be connected to a downstream microprocessor that, in turn, can activate various warning devices.

12 Claims, 16 Drawing Sheets

FAULT DETECTED ROUTINE #5

ERASE MEMORY
ROUTINE #7

CONFIGURE
ROUTINE #8

GAS BURNER MONITOR AND DIAGNOSTIC APPARATUS

This application is a continuation-in-part of U.S. patent application Ser. No. 08/819,540, filed Mar. 17, 1997 a U.S Pat. No. 5,761,092 was issued, which is a continuation-in-part of U.S. patent application Ser. No. 08/637,833, filed Apr. 25, 1996, now U.S. Pat. No. 5,612,904.

BACKGROUND OF THE INVENTION

1. Field of the Invention

The invention relates to diagnostic tools for gas burners.

2. Description of the Related Art

There is a need to log events that occur during the operation of a gas burner when there is an intermittent problem that causes the gas burner primary control to cycle to a safety standby condition.

Presently, the only method for a repair technician to diagnose and repair such an intermittent problem is to replace one part of the gas burner system each time there is a malfunction.

Occasionally, proper operation of a gas burner is interrupted by an intermittent condition that causes the burner to go to a condition, variously called safety standby, safety lockout, or to "go out on safety." When this occurs, manual resetting of the gas burner primary control by either the resident or a service technician is required. This condition can be caused by a faulty part in the gas burner, a faulty gas burner primary control, fuel delivery problems, or an improperly operating igniter assembly.

When the service technician arrives, the intermittent condition causing the safety lockout may or may not be still present. The gas burner may operate satisfactorily for several days, only to go to a safety lockout again when the intermittent condition reoccurs. This frustrating sequence can occur several times as presently the only method of diagnosis and repair available is to replace one part after another and wait to see if the problem reoccurs again. This process can take several days or weeks and throughout this period, the resident of the property is unsure whether the heating system of the building is reliable and whether any absence coincidental to such an occurrence will result in significant damage to the building due to freezing conditions.

U.S. Pat. No. 5,063,527, issued to Price et al. on Nov. 5, 1991, discloses a monitoring system directed to controlling safety aspects of burners. This is done by referencing real time conditions relative to reference standards. The system does not disclose or suggest the need for monitoring an historical record of operation or the necessary structure to accomplish such monitoring or is suitable for use with low voltage on/off thermostats found on residential gas burners.

U.S. Pat. No. 5,249,739, issued to Bartels et al. on Oct. 5, 1993, discloses an apparatus for sensing the operating condition of a burner system. Bartels et al. teaches a temperature sensor mounting within the exhaust flue and providing a temperature signal encoding the temperature of the combustion gases within the flue. Bartels does not measure the outside of the flue pipe nor utilize a light sensitive cell to indicate burner status (on or off). Bartels et al. uses the measured temperature level of the actual flue gases to evaluate heating system performance including efficiency at various fuel firing rates. Bartels et al. teaches monitoring gradual changes in the flue gas temperatures.

U.S. Pat. No. 5,005,142, issued to Lipchak et al. on Apr. 2, 1991, discloses a sensor system for communicating to a control section which compares the signals to a standard and then sounds a warning if there is significant deviation.

A system that logs the data history of residential gas burners, accurately recording the history of events as they occurred so that the record can be viewed for diagnosis of the problem is not taught in the prior art.

SUMMARY OF THE INVENTION

It is the aspect of the invention to provide a portable device that monitors changes in the status of certain functions of a gas burner system and conditions present, those being specifically: 1) the status of the thermostat, 2) the presence of, and 3) the level of voltage received at the main gas valve, 4) the pressure of the gas in the gas fuel piping at the inlet of the main gas valve, 5) the pressure of the gas in the gas fuel piping at the outlet of the main gas valve, and 6) a means to detect the absence or presence of flame at the gas burner either with a temperature sensor located on the equipment or a means of detecting visible flame, in order to permit a repair technician to monitor those events, recall past events and diagnose intermittent problems that might not be duplicated when the repair technician is present.

It is another aspect of the invention to provide a hand-held device capable of reading stored information that is provided by a permanently mounted unit or is integral with the gas burner that monitors changes in key gas burner functions.

It is still another aspect of the invention to provide a device that utilizes a microprocessor to permit monitoring several channels of inputs of information from a gas burner system, process that information, store that information with the time, and make that information accessible at a later time in an economical way.

It is still another aspect of the invention to provide immediate feedback of the monitored events that can be determined by attaching a data reading unit that will display changes in gas burner condition on the integral display screen of the data reading unit as the changes occur in order to permit a repair technician to monitor those events in realtime.

It is still another aspect of the invention to provide a device that will: 1) record changes in the status of critical events during the operation of gas burners; 2) store the recorded events with time and date in solid state, non-volatile memory for later review.

It is still another aspect of the invention to provide a device capable of determining when a fault condition has occurred in the proper operation of a gas burner by comparing whether the thermostat or aquastat is signaling for the gas burner to operate and whether, at the proper time, there is voltage present at the main gas valve, and, if so desired, to cause another piece of equipment to be activated in order to alert a responsible party of such a fault condition.

It is still another aspect of the invention to provide a device capable of determining when a fault condition has occurred in the proper operation of a gas burner by comparing whether the thermostat or aquastat is signaling for the gas burner to operate and whether, within a user preselectable period of time, there is gas pressure downstream of the main a gas valve. If gas pressure is not present, after the preselected time, then a fault would have been determined and the device would cause another piece of equipment to be activated in order to alert a responsible party of such a fault condition.

It is still another aspect of the invention to provide a data read unit having a keypad for the gas burner service technician to access information stored in the non-volatile memory of the data recording unit and thereby aiding in the determination of what anomaly in the operation of the gas burner caused the fault condition and permit the proper corrective action to be taken.

It is still another aspect of the invention to utilize a EEPROM (electrically erasable programmable read only memory) chip to preserve data to minimize the possibility of data being lost if the device is unintentionally powered-down, so that the repair technician will have the greatest likelihood of determining the cause of the gas burner problem.

It is still another aspect of the invention to monitor the status of the thermostat or aquastat to determine when the gas burner should operate.

It is still another aspect of the invention to monitor the presence and quality of voltage received by the main gas valve to aid in determining the performance of the primary controller.

It is still another aspect of the invention to provide a power-down circuit for the central processor unit to minimize the possibility of data being lost if power is unintentionally lost to the device.

It is still another aspect of the invention to provide sufficient information on the display screen of the data reading unit to allow complete operation of that unit without the need for an instruction manual.

It is another aspect of the invention to allow certain monitor functions to be disabled so that the device can be utilized on a variety of gas burner systems.

It is another aspect of the invention to monitor the presence or absence of flame at the main gas burner by means of either, 1) vent stack temperature readings taken from the outside surface of the vent stack pipe utilizing a thermistor that attaches to the outside of the vent stack using existing components of the vent stack system, or, 2) the change in electrical resistance in a circuit caused by the presence of flame as sensed by a light sensitive cell.

It is another aspect of the invention that, when a fault condition has been determined to have occurred, the device will cease gathering any further data and, with the exception of intentionally erasing stored data, there is no operational way to lose the remaining data, allowing the primary controller to be reset and, if possible, to restore operation.

It is the final aspect of the invention to provide an intelligent port to allow the central microprocessor to communicate with other "downstream" microprocessors, called auxiliary boards, to allow the monitoring of other functions of the gas burner system and to allow for auxiliary functions to be developed at a later date.

The invention is a monitor and diagnostic apparatus for a gas burner having a thermostat or aquastat (herein both are referred to as thermostat), a main gas valve and a vent stack. Depending on the configuration, the invention may have one or two major components. In the configuration of a completely portable diagnostic device, the invention has one major component which combines both a data collecting means (herein called the data collection unit) and an integral LCD screen for reading the collected data (herein called the display). In the configuration of a device that has components that are permanently attached to the gas burner system, the invention has two major components: a data collection unit that is permanently attached to or integral with the gas burner and a portable data reading unit that can be connected to the data collection unit to read the data stored in the data collection unit. First sensing means is provided in the data collection unit for producing a first signal corresponding to the voltage at the thermostat connection of said gas burner system. Second sensing means is also provided in the data collection unit for producing a second signal corresponding to the voltage at the terminals of the main gas valve of said gas burner system. Third sensing means is provided in the data collection unit for monitoring the presence or absence of a flame at the main gas burner by producing a third signal either corresponding to the temperature on the outside of the vent stack or the change in resistance in an electrical circuit which is altered by a light sensitive cell. Fourth sensing means is provided in the data collection unit for monitoring the signals produced by the pressure sensors/auxiliary board system, with the pressure sensors installed in the gas valve piping both before and after the main gas valve, said signals corresponding to the gas pressure in the gas piping at those points. Central processing means is provided for processing the first, second, third and fourth signal from said first, second, third and fourth sensing means, respectively. The processing means provides an output corresponding to the operational history of said gas burner over a pre-selected time interval. Memory means for recording the output of said central processing means that corresponds to the operation history of said gas burner over a pre-selected time interval is also provided. Display means for displaying the recorded output of said memory means, such display means either integral with the data collection and processing means or in the portable data reading unit is provided. A user of said apparatus is able to determine the operational history of said gas burner over a pre-selected time interval by viewing said display means.

DETAILED DESCRIPTION OF THE INVENTION

Figure 1:
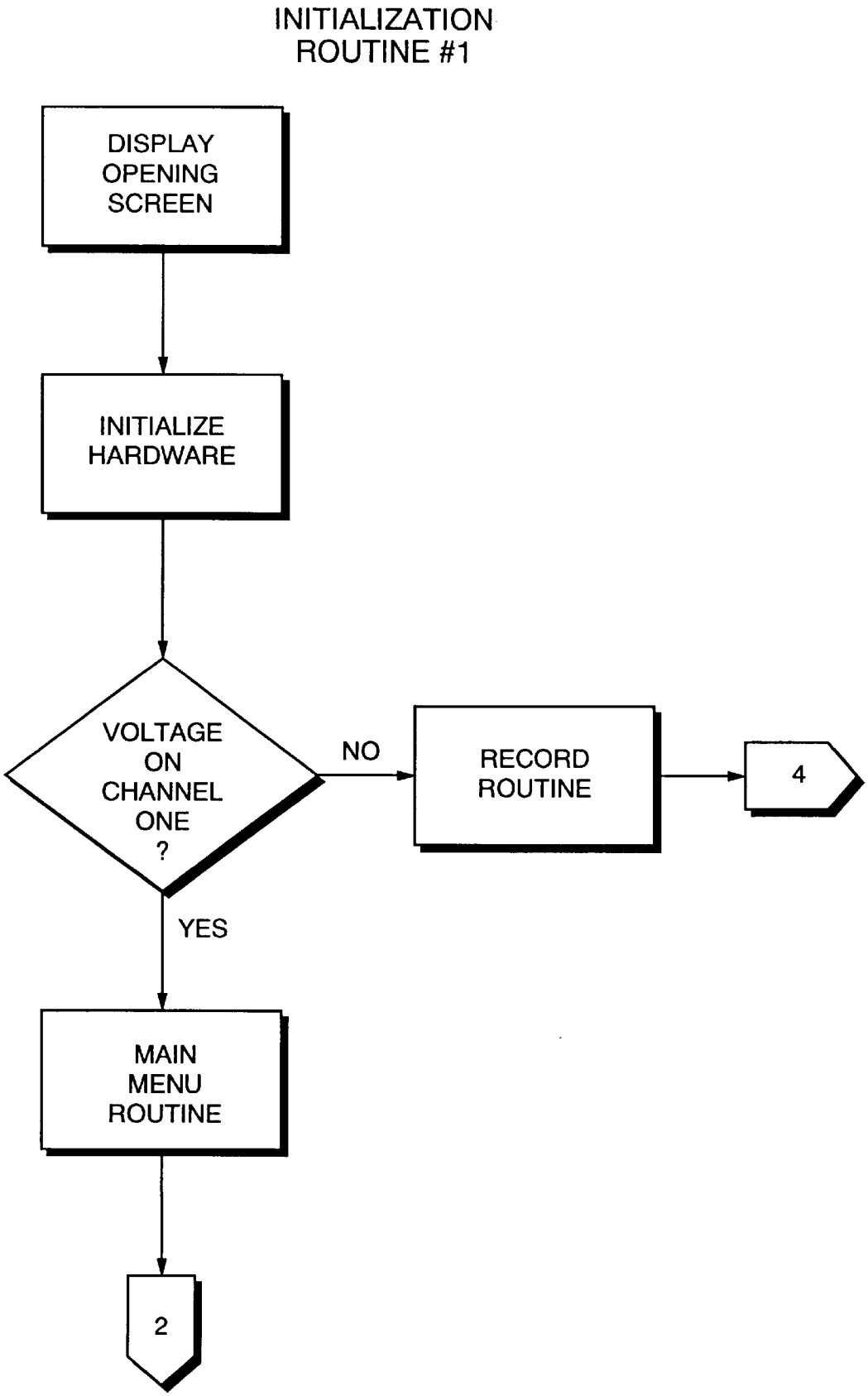
FIG. 1 is a flow chart illustrating the initialization operation of the apparatus.
Figure 2:
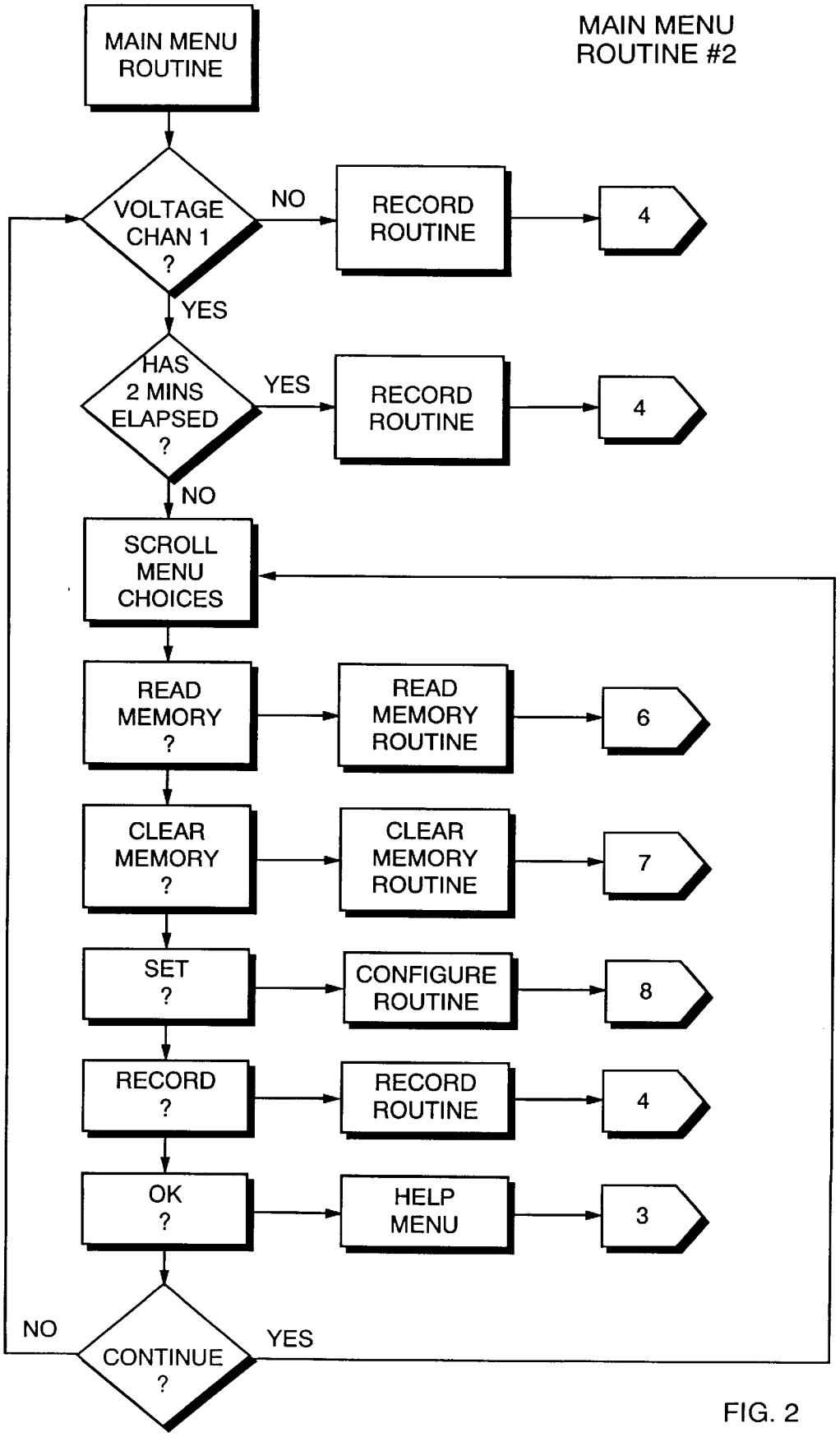
FIG. 2 is a flow chart illustrating the main menu operation of the apparatus.
Figure 3:
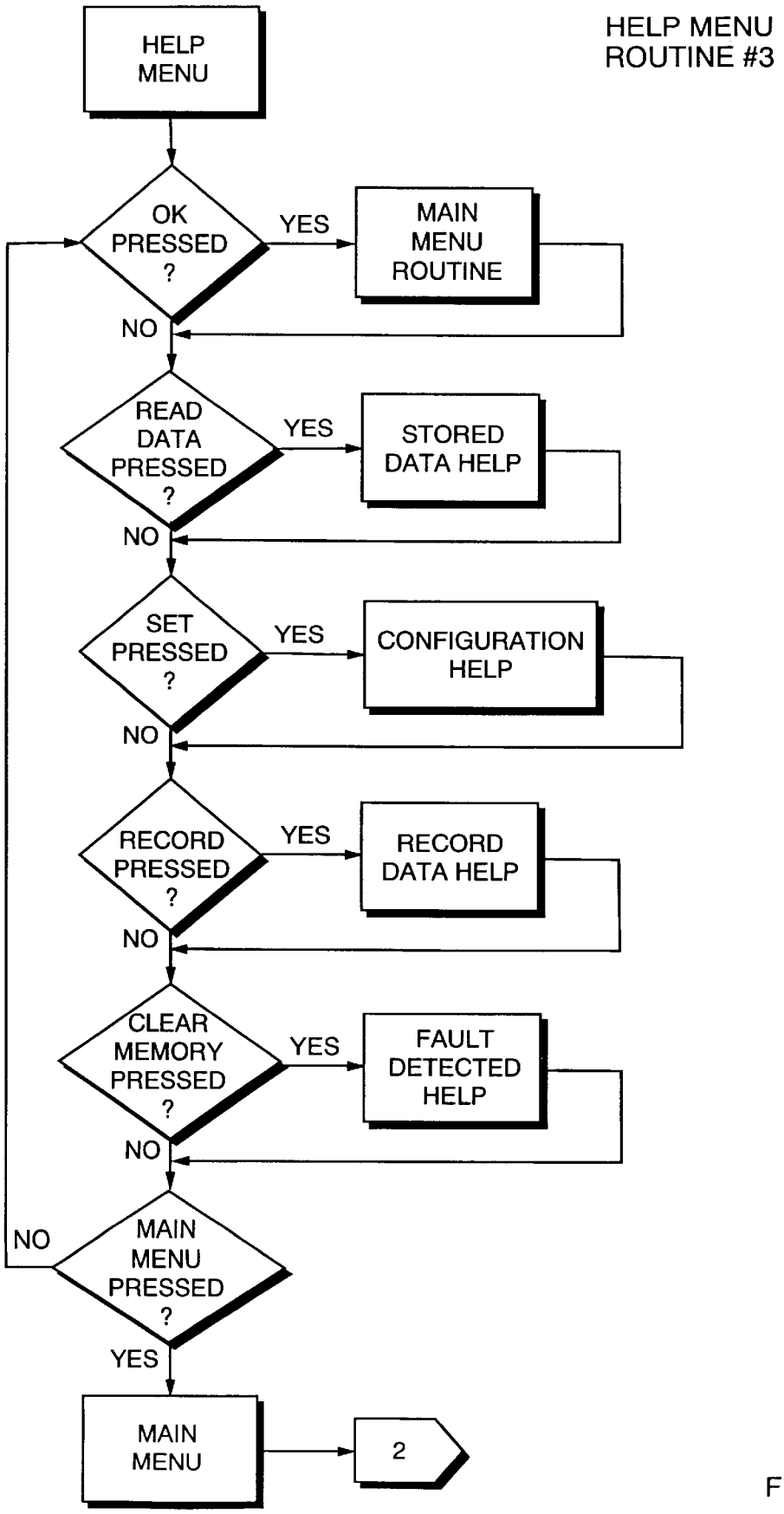
FIG. 3 is a flow chart illustrating the connections menu operation of the apparatus.
Figure 4:
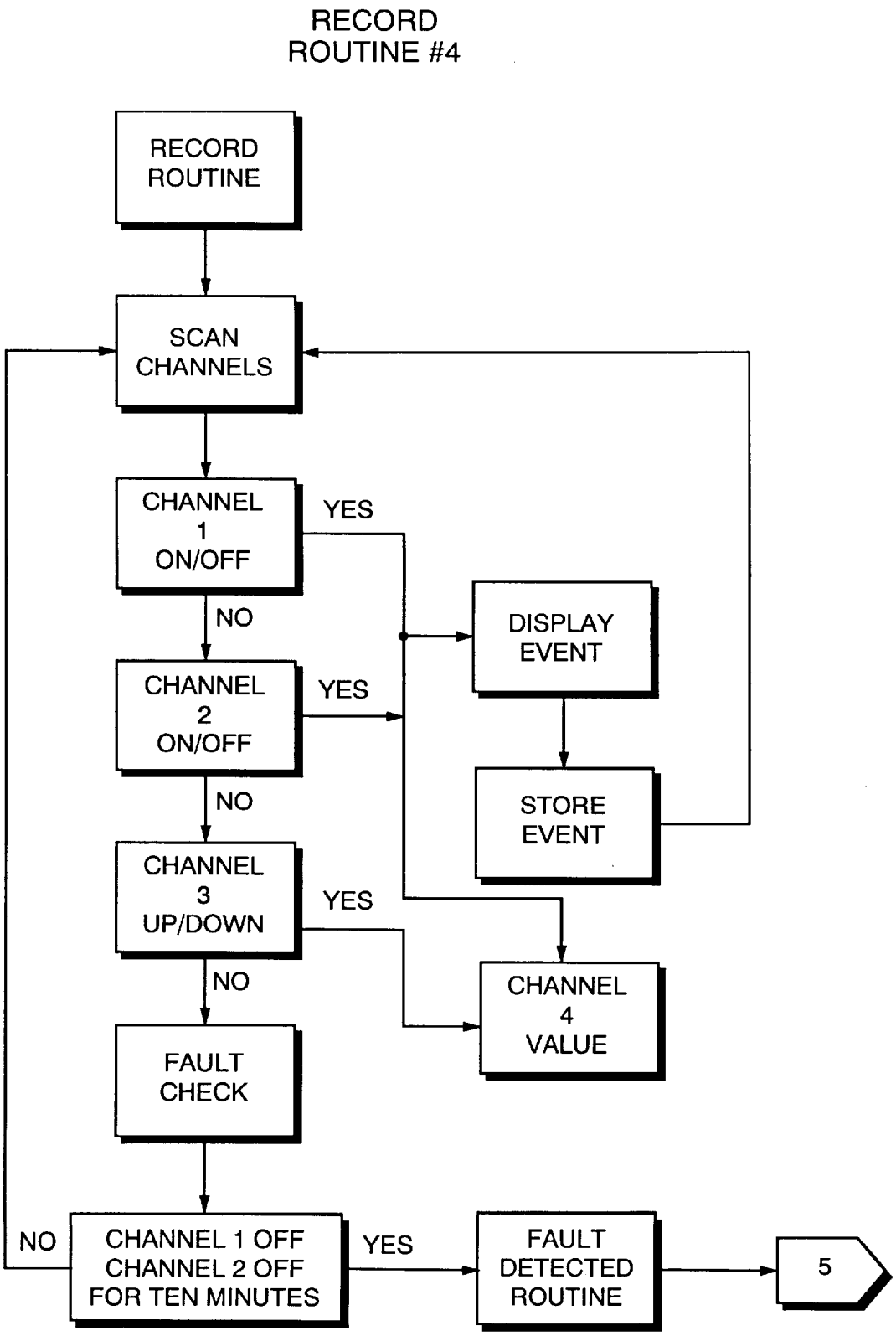
FIG. 4 is a flow chart illustrating the record operation of the apparatus.
Figure 5:
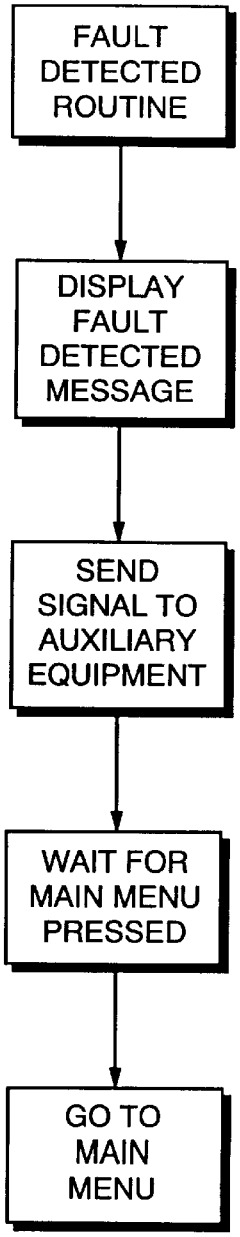
FIG. 5 is a flow chart illustrating the fault detection operation of the apparatus.
Figure 6:
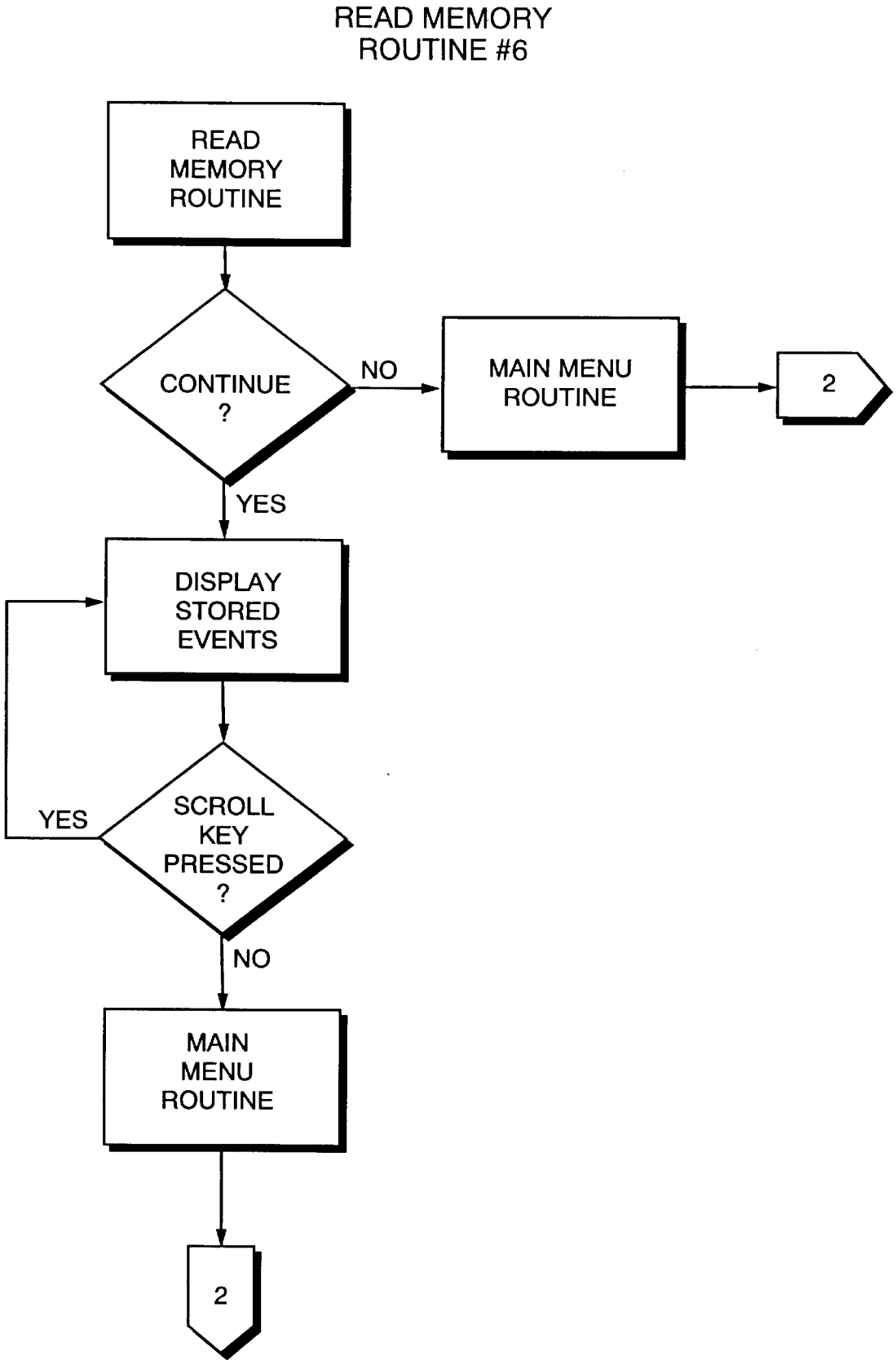
FIG. 6 is a flow chart illustrating the read memory operation of the apparatus.
Figure 7:
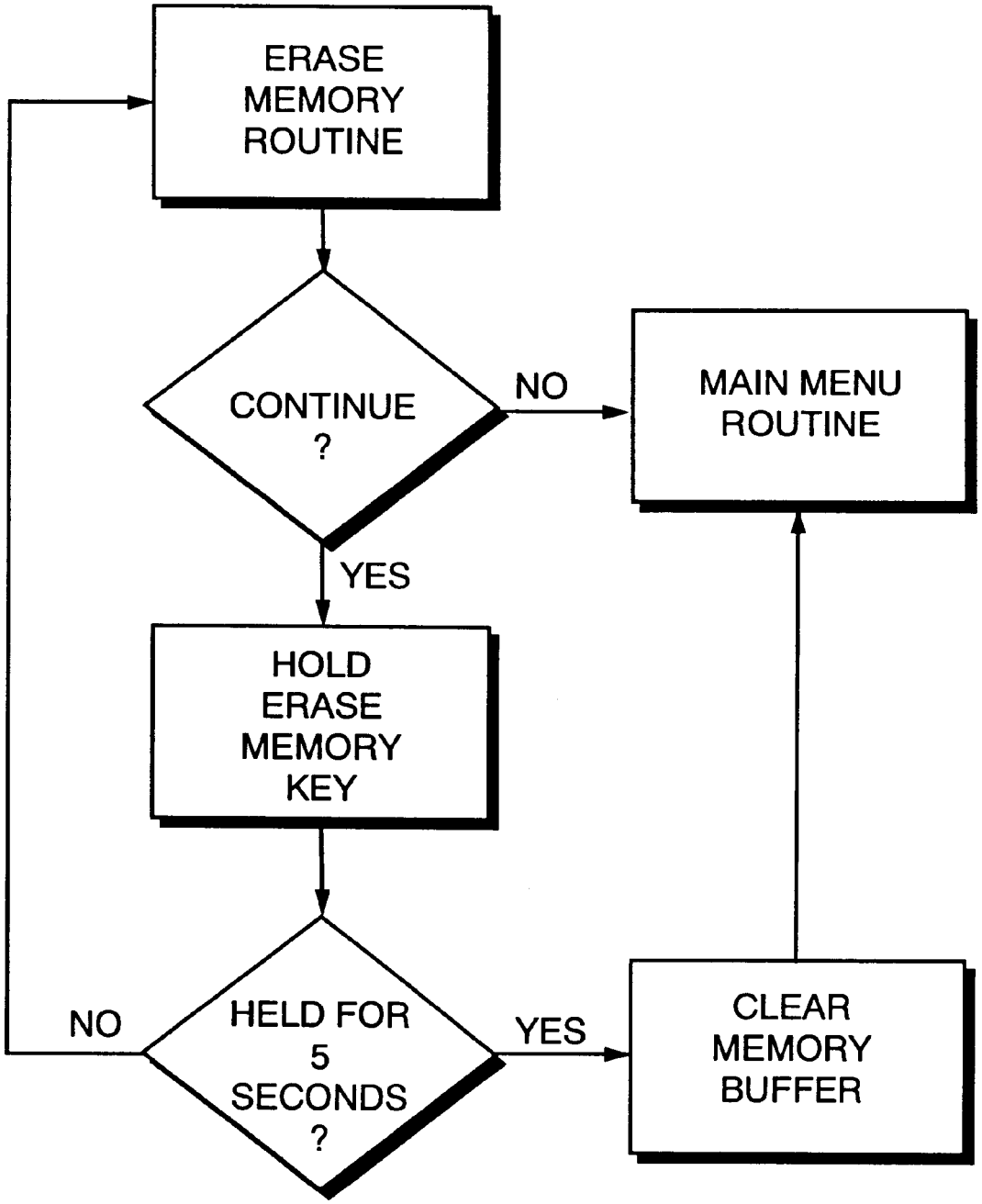
FIG. 7 is a flow chart illustrating the erase memory operation of the apparatus.
Figure 8:
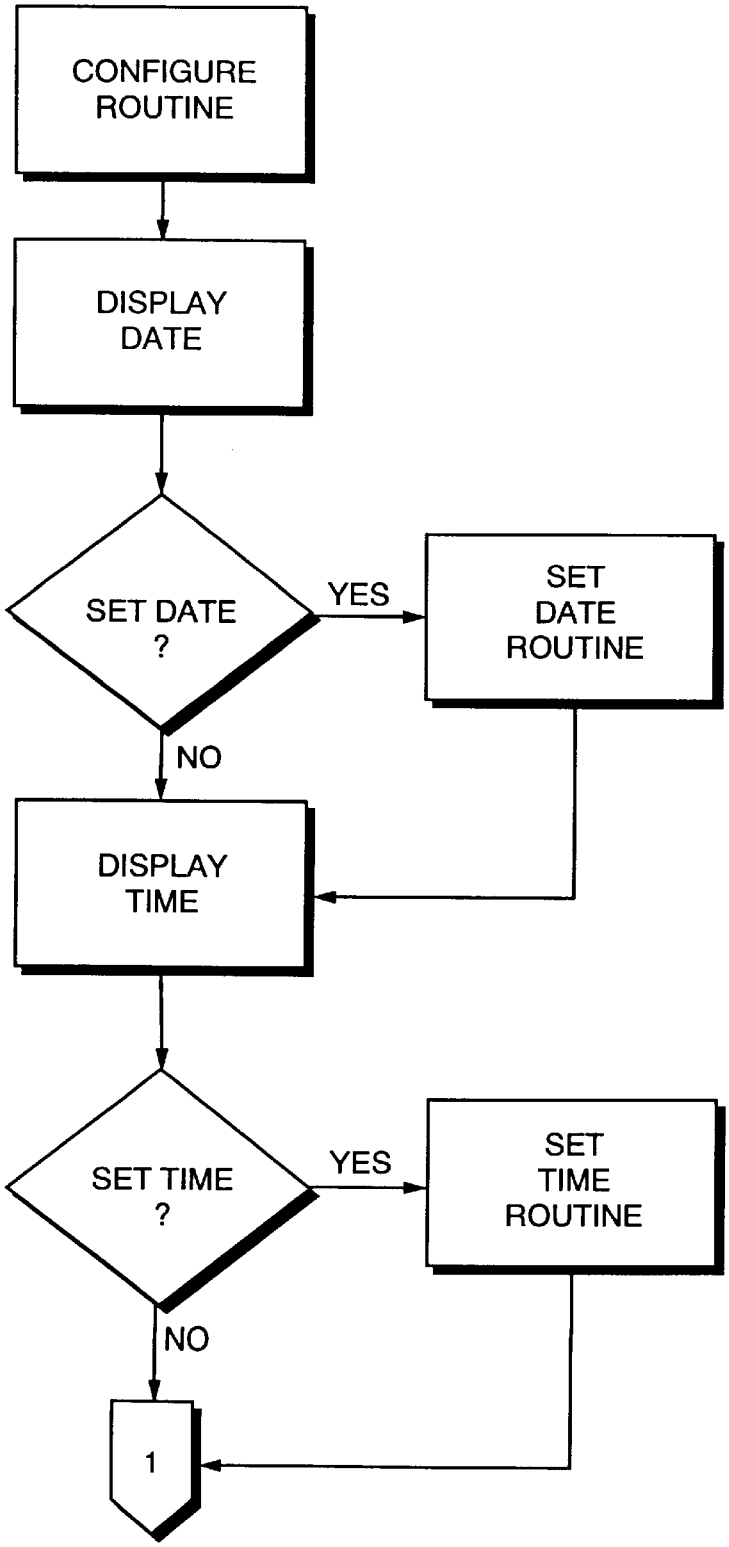
FIG. 8 is a flow chart illustrating the configure operation of the apparatus.

The invention is a monitor and diagnostic apparatus having either a portable or a permanently attached integral data logging unit that is connected to a gas burner. If the data logging unit is portable, an integral display is provided so that the data stored therein can be viewed by a technician. If the data logging unit is permanently attached, a portable data reading unit is provided that can be attached to the data collection unit so that the data stored therein can be viewed by a technician. The data collection unit will record a sequence of relevant events and store that information with the time in non-volatile memory, and will also determine when a fault condition has occurred in the gas burner.

By using this monitor and diagnostic data logging apparatus, the gas burner repair technician, using either the integral display or the data reading unit, can review the logged events and determine what part of the gas burner system malfunctioned and make the correct repair on the first service call after the unit is installed.

When such a fault condition occurs, an appropriate signal will be sent through the auxiliary intelligent port to an optional downstream microprocessor, which can activate another piece of equipment to alert a responsible party. When the service technician responds, he/she will be able to retrieve, through the controls provided, in the case of the portable unit, on the integral keypad or, in the case of the permanently attached data collector, on the keypad of the data reading unit, the stored data via an LCD display to aid in determining what caused the gas burner to "go out on safety," i.e. what caused the fault. This will allow a completed repair on the first service call after the device is installed.

Operation of the Invention

The invention is a device designed to monitor several electrical, one temperature condition or flame quality on a gas burner, and the gas pressure at two points of the gas piping, record changes in their conditions, identify these changes with time, and store that data in non-volatile memory. Additionally, if certain conditions exist, the device will make a determination that a "fault condition" has occurred, will indicate so on a screen, if so provided, and provide a means of activating another device to notify personnel. The information stored in non-volatile memory will be available for review on a screen and will allow a trained technician to review the events leading up to the "fault condition" and aid in determining the likely cause.

The apparatus is connected to several points of a gas burner system. It will record the important events that occur during the operation of a gas burner. It will log what occurred, along with the time, and store that information in non-volatile memory which can be accessed by a repair technician at a later time. It will also determine, through software, when a fault condition has occurred in the gas burner and, through communication with a down-stream microprocessor connected to a jack, activate another piece of equipment which will alert a relevant person, if so desired.

The device features an Intel 80C188EB central processor unit (CPU) microprocessor that receives instructions from an EPROM. The CPU receives information from four channels (or inputs) which are connected to various points on a gas burner system. The CPU processes the information, displays it on the display of the data reading unit, and stores the information in the non-volatile memory. This stored information is available by manipulating, in the case of the portable data collector, the integral keypad or, in the case of the permanently attached unit, the keypad of the data reading unit and then can be visualized through the display.

The apparatus uses software which, when the unit receives power and if so desired, will guide the repair technician step-by-step through the set-up and connection procedure so that an instruction manual is not necessary.

Figure 9A:
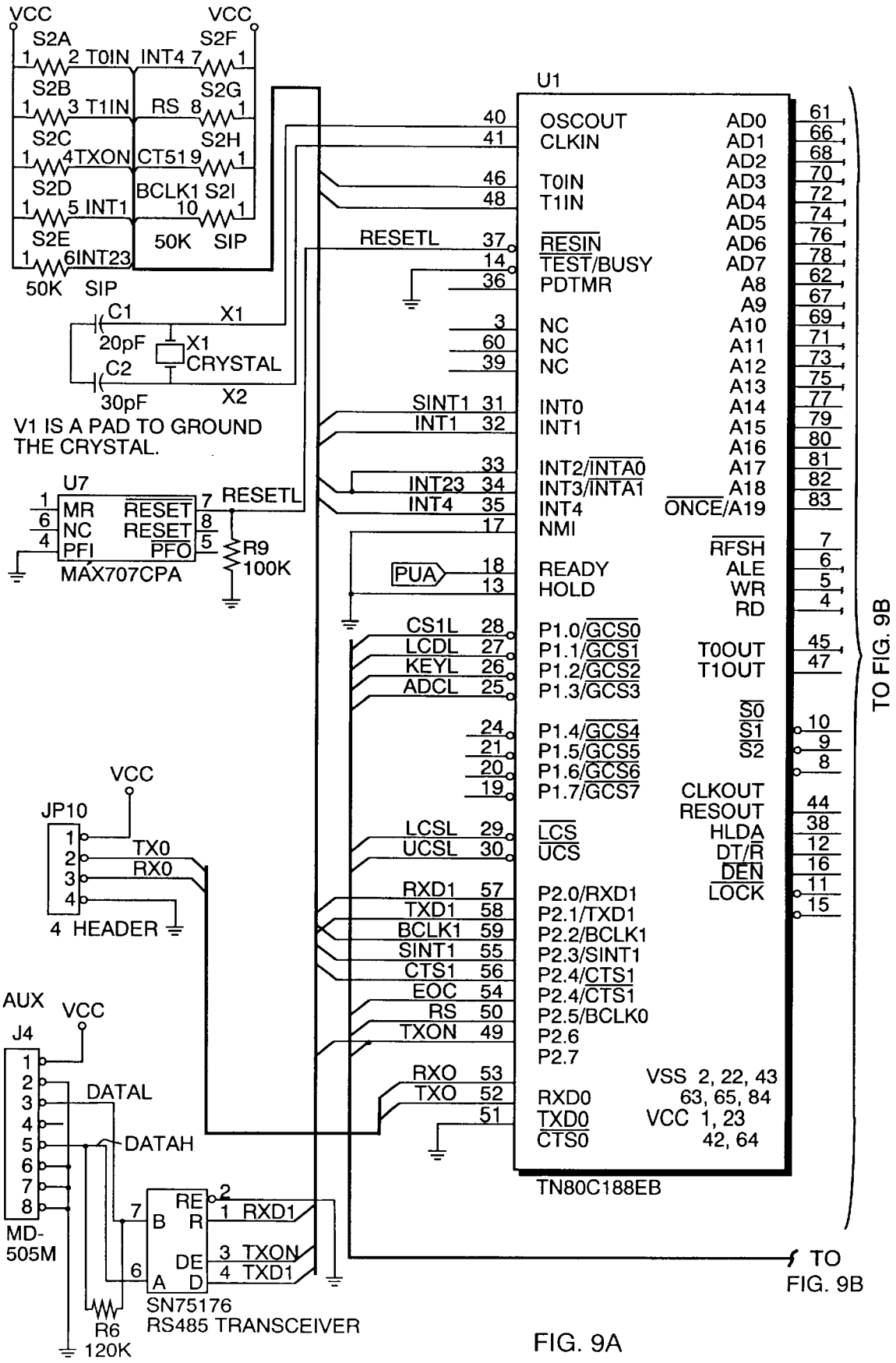
FIGS. 9A through 9E are a schematic of the gas burner data logging apparatus in accordance with the invention.
Figure 9B:
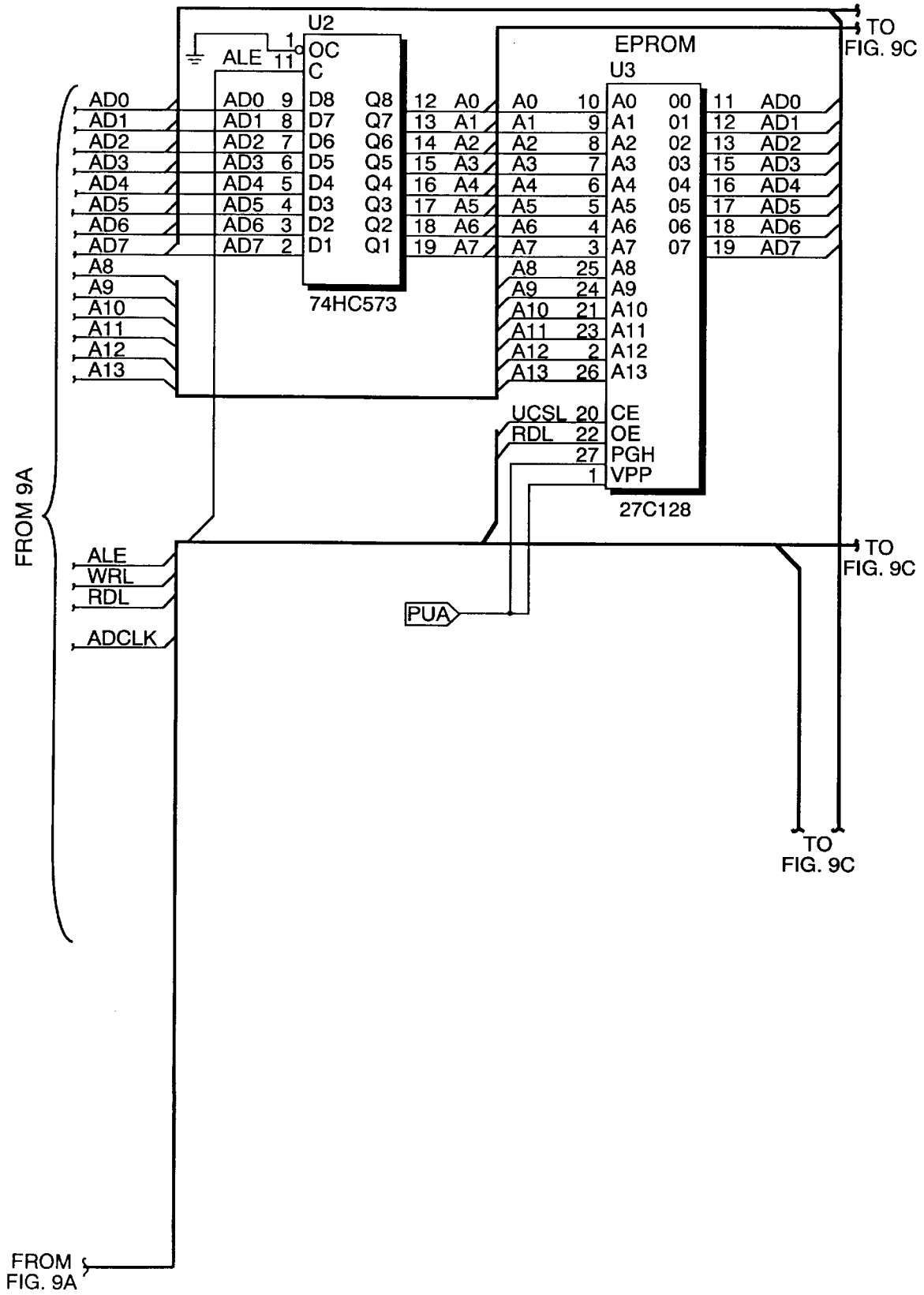
Figure 9C:
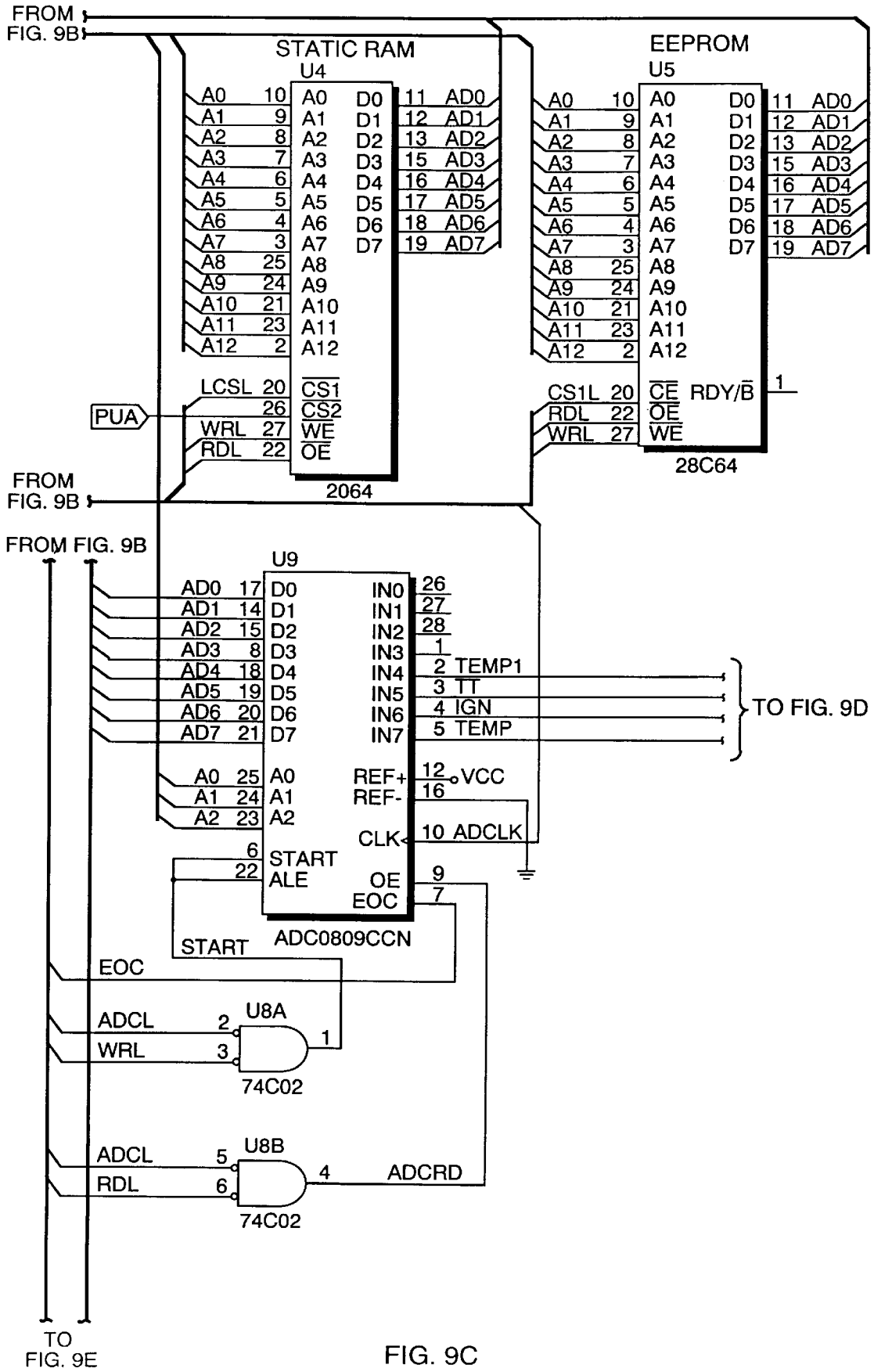
Figure 9D:
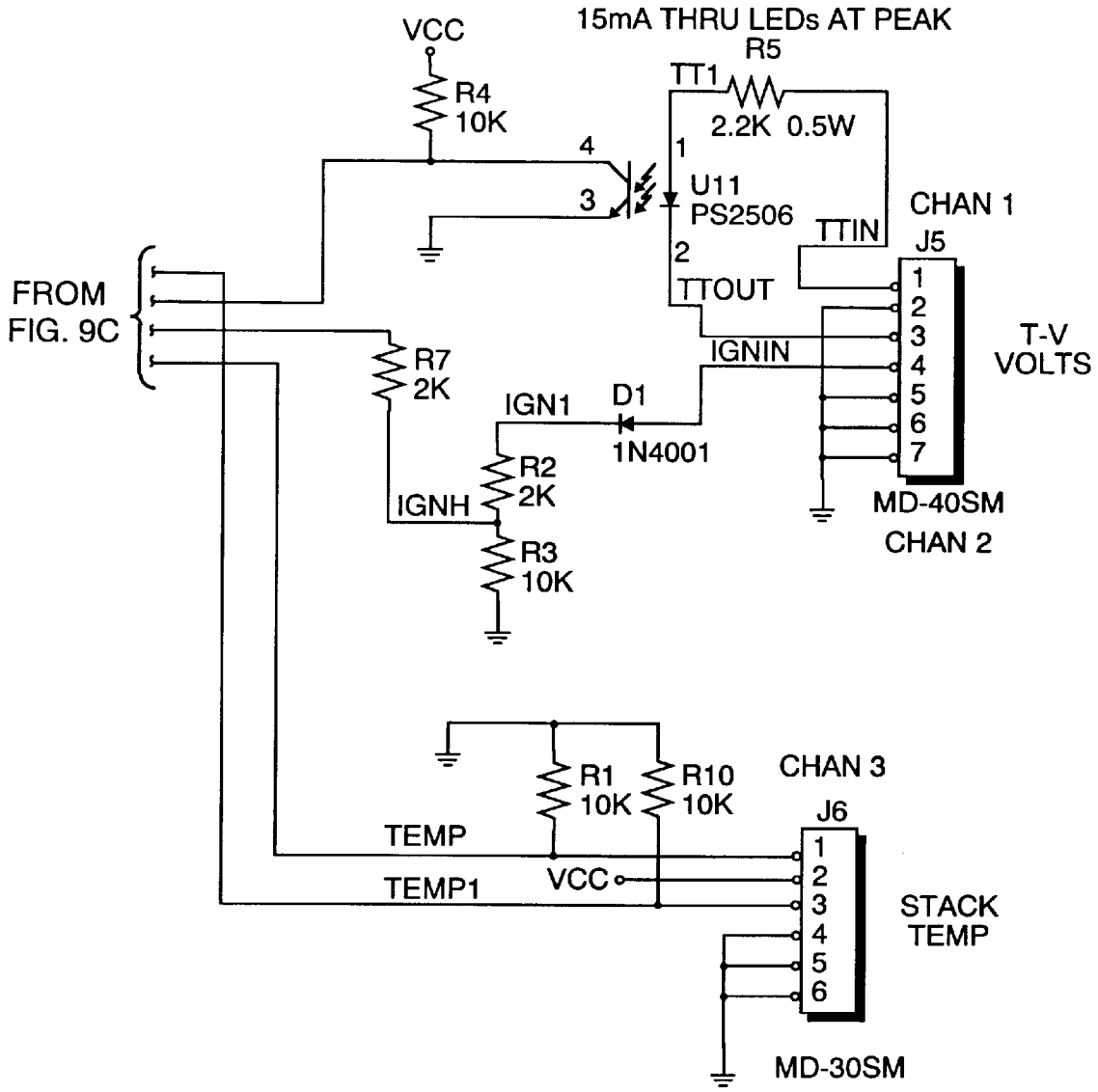
Figure 9E:
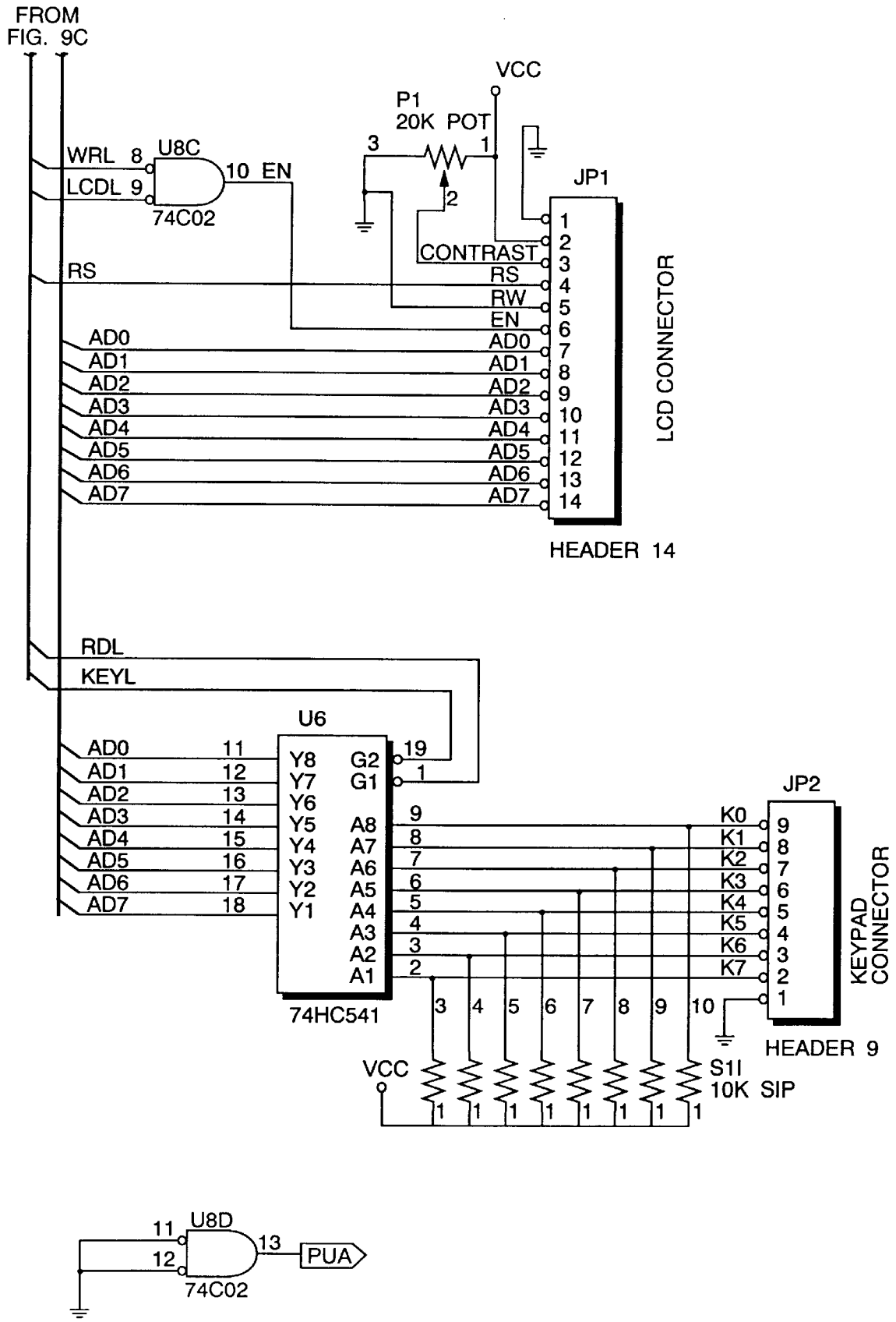

The apparatus, through Channel 1, monitors activation and deactivation of the gas burner primary control by the thermostat or aquastat and records the event with the time into EEPROM. Specifically this is done by monitoring the presence or absence of 24 or more volts AC at the thermostat connections of the gas burner primary control. This voltage is received through Jack 5 or input CHAN 1, as shown on FIG. 9D.

The apparatus, through Channel 2, monitors the activation and deactivation of the main gas valve of the gas burner by the gas burner primary control and records the event with the time into RAM. Specifically, this is done by measuring the presence or absence of AC voltage at the input terminals of the main gas valve. This voltage is received through input Jack 5 or input CHAN2, as shown on FIG. 9D.

The apparatus measures, through Channel 2, the voltage, Voltage A, present at the input terminals of the main gas valve. This voltage is sampled and recorded at the time voltage is sensed (defined as 1/30 second) and thereafter every two seconds for the first ten seconds after it is sensed, thence every 5 seconds for the next 40 seconds.

The apparatus monitors, on Channel 3, the resistance in a circuit attached either to a thermistor attached to the outside of the vent stack of the gas burner or the resistance across a light sensitive cell. The CPU measures the resistance of the thermistor or light sensitive cell at the time that voltage is sensed on CHAN2 (defined as 1/30 second after voltage is first detected) and thereafter once every 2 seconds for the first 10 seconds, thence every 5 seconds for the next 40 seconds. A change in resistance reflects whether the temperature is rising or falling in the vent stack, if a thermistor is connected, or whether there is flame present at the main gas burner, if a light sensitive cell is used. The CPU compares the resistance reading of the thermistor or the light sensitive cell and, through a "look-up table" contained in the EPROM, determines respectively what the temperature of the vent stack is or whether flame is present, and records that information with the time in RAM. The thermistor or the light sensitive cell is connected to Jack J6.

The apparatus monitors Channel 4 to which an auxiliary board is attached, which has pressure sensors A & B, attached. The signals received on Channel 4 (Jack 4) contain data from the pressure sensors that are attached to the gas piping before and after the main gas valve, these signals already having been processed by the microprocessor of the auxiliary board, are recorded with time in RAM. These values are compared to the values in a "look-up table" contained in the EPROM, thereby determining what the pressures in the gas piping are at the inlet and the outlet of the main gas valve and records that information with time in RAM. These readings are recorded at the time that voltage is sensed on CHAN2 (defined as 1/30 second after voltage is first detected) and thereafter once every 2 seconds for the first 10 seconds, thence every 5 seconds for the next 40 seconds.

The apparatus further samples the information received on Channels 1 and 2. If Channel 1 is recorded as having 2.5 or less volts AC continuously for 10 minutes and if, during that same time, Channel 2 does not have 18 or more volts AC, then the software declares that a fault condition has occurred and the equipment branches to the Fault Condition subroutine which causes the recording of events to cease and a signal is sent, through Jack J4 to any downstream microprocessor, which can cause another piece of equipment to activate that will alert a responsible person.

The apparatus will also detect when a fault condition has occurred by comparing whether the thermostat or aquastat is signaling for the gas burner to operate via monitoring Channel 1 and whether there is a gas pressure downstream of the main gas valve after a reasonable length of time via monitoring Channel 4. The reasonable length of time can be selectable by the user, if desired, or could be factory set. If gas pressure is not detected, then, as above, the equipment branches to the Fault Condition subroutine. The recording events are ceased and a signal is sent, via Jack J4 to any downstream microprocessor, which can cause another piece of equipment to activate to alert a responsible person.

The service technician can, in the case of the portable device, by operating the controls on the integral keypad on the apparatus, or, in the case of the permanently attached device, by operating the controls on the keypad of the portable reader unit, display the information stored in the non-volatile memory. The information will be displayed in plain language on the LCD display screen. By reviewing the stored information, the sequence of events for Channels 1–4 can be examined, and the repair technician can likely determine what part of the gas burner system malfunctioned.

Description of the portable embodiment

Figure 11:
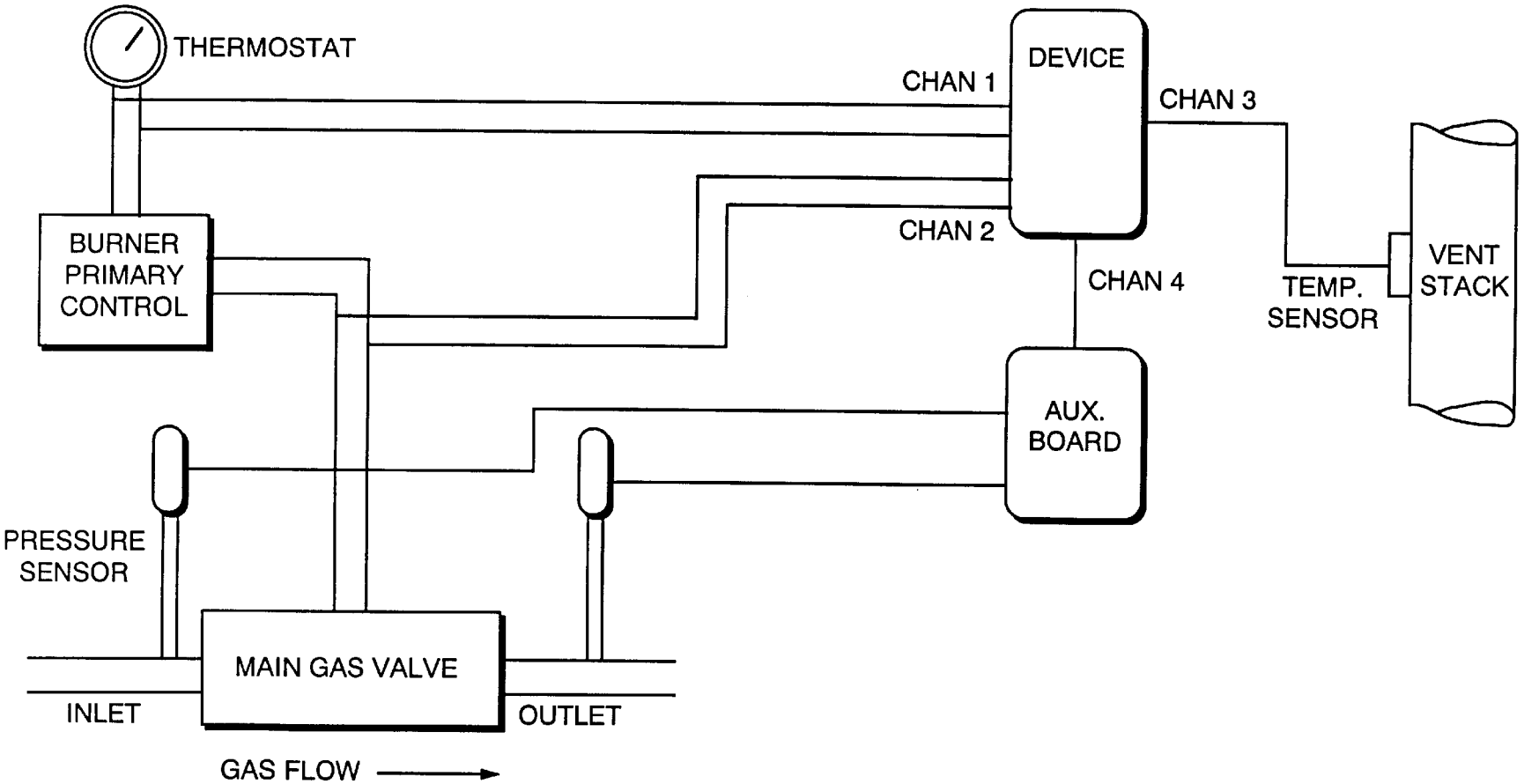
FIG. 11 is a block diagram of typical gas burner showing the data logging apparatus permanently connected or integral with the burner and a separate portable reader apparatus.

The apparatus, as described above and as shown in FIG. 11 contains a data logging circuit with a CMOS computer, various power control circuitry, a keypad, an LCD display, and I/O conditioning circuitry to monitor the various inputs as described above.

The CMOS computer section has several components. U1, an 80C188EB microprocessor, which is available from Intel. This processes the software and the information received from the inputs.

The crystal, X1, is a 16 MHz crystal. It is a parallel resonant crystal that provides input to the microprocessor.

The EPROM, which is U3, is a 27C256, which is a 32K×8 byte EPROM, available from SGS Thompson.

The RAM, U4, is an 8K by 8 static RAM, 8464A, available from Fujitsu.

The EEPROM, U5, is a 28C64, 8K×8 electrically erasable programmable read-only memory, available from Atmel.

U2, which is an address latch, is a 74HC573, which is available from S G S Thompson. Since the 80C188EB has a multiplex address databus, it is necessary to de-multiplex the address from the data, and that is the purpose of U2.

U9, an ADC0809CCN, is an analog to digital (A/D) converter, available from National Semiconductor. This is an 8 channel ratiometric converter.

The next devices are for logic. U8, a 74C02 NOR GATE, ties in the logic necessary for the ADC0809, which is not Intel-based. It has four NOR GATES in the package. The first, U8A, is used to combine the A/D chip select and the write signal to produce a starting post for the A/D conversion.

U8B uses the chip select from the microprocessor along with the read line to read the data that was converted from the A/D.

U8C uses the write signal from the microprocessor as well as the chip select from the microprocessor to provide the enable line for the LCD.

U8D, the last NOR GATE, is used to pull up signals that require a high input, for example the static RAM and the EPROM.

U7, a MAX702CPA available from Maxim, is a chip used to produce the reset for the microprocessor. As well as producing a reset on power-up and power-down, detecting power failure, it also, with two resistors and a voltage divider, can produce a power fail output.

U12, a RS485 driver using a MAX487CPA transceiver, available from Maxim, is used for the auxiliary output to communicate with any downstream microprocessors. It meets all the EIA 485 interface codes and communicates through J4 to any downstream microprocessors.

The power circuit receives 9 volts DC through Jack J3. That power goes through the switch SW1, and feeds two regulators, U13 and U10. One feeds power to the microprocessor and the other feeds power to the LED backlight of the LCD as well as the auxiliary output, J4. U13 and U10 are both LM7805, available from National Semiconductor. The power-in circuit is protected by diodes, D3 and D4, so that if there is reverse polarity received at J3, the board will not be damaged. Also the regulators are protected from short circuits on the input lines.

JP 10 is a 4-pin connector that is used as a serial port for U1 and is available for future use.

Jack J6, a 3-pin connector, is used for the thermistor or light sensitive input for, respectively, stack temperature or presence of flame. This uses 2 pins of the connector, J6, one being common. The remaining pin of J6, along with the common, is available for future use. This circuit is wired as a voltage divider.

J5, is a 4 pin connector. It is used to connect to the thermostat and the step-own transformer inputs. Pins 1 and 3 are used to monitor the output voltage at the thermostat connections of the gas burner primary control. This can be up to 24 volts AC. This signal is received; going through a 2.2K ½W current limiter which is connected to an opto-isolator, U11, a PS2506, available from NEC.

Pin 4 of J5 receives the voltage from the step-down transformer, which is connected to the input terminals of the main gas valve, through a diode and then through a voltage divider. This voltage is fed to U9, the A/D converter. After processing by U1, 3.3 volts AC from the step-down transformer translates to 24 volts AC at the input terminals of the main gas valve. Other received voltages are interpolated by U1 to reflect the original voltage at the primary leads.

Jack J4 is the Auxiliary Port which can communicate with other downstream microprocessors, such as the auxiliary/pressure sensor assembly or a device to alert a relevant person in the event of a heating system failure. Pin 1 on J4 is VCC, Pin 2 is ground, Pin 3 is the positive data output and Pin 5 is the negative data output. Pin 4 is reserved for future use.

J11 is a connector to supply voltage to the LED backlight of the LCD. The LCD is available from Optrex and is a model DMC16202-LY-NY-1, and has an LED backlight. It is connected to JP1.

The keypad is a proprietary 8-key keypad with a common line. It is connected to JP2. It is fed into U6 which is a 74HC541 buffer. It is controlled by the microprocessor. U6 is available from Toshiba.

Through J 4 of the device, an auxiliary device (or board) can be attached which is an analog sensor device that allows two pressure sensors to be attached. These sensors can measure pressure of the gas, one being installed before the main gas valve and one after the main gas valve. This auxiliary board conditions the signals from the pressure sensors and, using a set of values stored in an EEPROM on this same auxiliary board, converts the voltages from the pressure sensors to pressure values and transmits those pressure values, through the RS485 communication bus, transmits those values to the main device.

Referring to schematic of the auxiliary board, starting in the upper right and proceeding from left to right:

U4 is a voltage regulator (LM7805). It draws its power from the RS485 communication bus, which is J1 and J2. These two connectors are in parallel so that when this auxiliary board is connected to the main device through J4 of the main device, it allows other devices to be connected further downstream into the same network cable. The 9 volts DC is provided by the wall adapter that is powering the main device. This power goes through U4 (LM7805) to provide the regulated 5 volts to the board. U2 is the RS485 interface. This chip takes the differential signals from the communications bus and converts it into TTL, normally digital 0_s & 1_s.

U1 is the microcontroller, which is the main processor for the auxiliary board, is from Microchip Technology and is a PIC 16C71. This microcontroller has 4 channels of a–d converter, a timer and assorted other devices inside it. Two a–d channels are used to monitor the sensors.

U3 which are op amps that provide the amplification and signals conditioning for the sensors.

U5 which is a serial EEPROM. This is where the calibration data is stored as well as the address for this device.

The sensors themselves are connected into J3 and J4 connectors of this auxiliary board. The pressure sensors are identical and are used to measure the gas pressure before and after the main gas valve. The sensors can have either a potentiometer or a ratiometric output or could have an active output, or a voltage source output. One source for pressure sensors is Data Instruments Inc.

All program code for the main device is contained within the EPROM, U3. U3 contains two application programs. One is the BIOS, which is the basic input/output system. The other is the application code. Upon power up, the BIOS is run from the EPROM. It sets up the microprocessor, every address for the chip selects, tells the microprocessor where the RAM is located, where the EPROM and the EEPROM are located. It also tells the microprocessor where the A/D converter is located and the keypad and keypad buffer. It also sets up all the hardware interrupts from the A/D converter, the serial ports, the software interrupts to communicate with the RS 485, the interrupts for the internal buffers, as well as having a debug program to use for Channel 0 serial input.

On powerup, the microcontroller of the auxiliary board does a self-test to make sure that it is operating correctly. If it does fail, then it will not communicate with the main device. The main device will indicate same by an indication on the LCD screen that there is no auxiliary device connected. After that the microcontroller of the auxiliary board goes to the EEPROM and loads the calibration data for the sensors and stores that in the RAM. Then it waits in an endless loop waiting for commands from the main device through the RS485 port. There is a list of commands that this microcontroller can execute:

1) ability to read and write to the EEPROM: this command is called EEPROM read and EEPROM write. This is how the calibration is done. The data is collected and then is transmitted through the microcontroller and certain commands tell the microcontroller to either store the data to the EEPROM or read the data from the EEPROM and transmit it through the RS485 to the main device. 2) ability to read the pins in the port, which is called an I/O read: These are the sense pins, which is how the main device determines whether a sensor is plugged in or not. Periodically the microcontroller is asked to return the current values of the sense pins and the main device can then determine whether a sensor is plugged in or not.
3) a–d reads: the microcontroller reads the a–d converter 128 times and then averages the results. There is a period of 5 milliseconds between each of the reads. This acts as a sliding average filter, reducing noise. The noise is reduced by the square root of 128.
4) There is a command to determine what version of software is in the microcontroller. As the main device powers up, it asks for a version number of the software of the auxiliary device. If the microcontroller of the main device receives a version number, it assumes that the microcontroller o the auxiliary device up and has sensors connected.

The microcontroller of the auxiliary board is a slave and the main device is the master. The components of the auxiliary board do not do anything unless instructed by the main device. All the commands are in a special protocol that is specifically designed for these components.

Once everything is properly set up, configured, the EEPROM is tested and passes, and then it goes to the application program. It first initializes the LCD display to make sure it is receiving information. It sets up the interrupt for the internal timer, which is a 10-millisecond interrupt. It also sets up another timer for delays that are needed in the program. Then it sends a message to the LCD and starts the program.

After the title screen is displayed, the program waits in MAIN MENU until the operator makes a choice by way of the integral keypad. If no choice is selected within two minutes, the program branches directly to the RECORD routine, described below. The MAIN MENU has several branches to other routines.

If the MAIN MENU key is pressed within the 2 minutes, nothing happens because the program is already in MAIN MENU.

If the OK key is pressed, the program branches to the HELP subroutine, which provides several choices to the operator in receiving additional information on operating the device.

If the READ DATA key is pressed, it branches to the READ DATA routine, which allows the operator to read the data, which has been logged into the EEPROM. By manipulating the scroll keys and viewing the LCD display, the operator can access the stored data. The data is stored in the EEPROM in a structure that is circular, and the first data available through the scroll keys is either the most recent data or the oldest. If the operator pushes the FORWARD scroll key, the oldest data will be shown. If the operator pushes the BACKWARD scroll key, the newest data will be shown. From the READ DATA routine, if the MAIN MENU key is pressed, the program returns to the main menu.

From the MAIN MENU, if the SET key is pressed, the program branches to a routine that allows the device to be configured. The configure routine allows the time to be set and also permits the operator to deselect any inputs so that they will not be recorded. This allows the unit to be used on certain brands of gas burners. After all the options are chosen, the last screen of the configure routine is a status screen which informs the operator of what the time is and whether any inputs have been deselected. The MAIN MENU key returns the program to the MAIN MENU routine.

From the MAIN MENU, if the CLEAR MEMORY key is pressed, the program branches to the CLEAR MEMORY routine. This routine first asks the operator to confirm the choice by pressing the OK key. If the OK key is pressed, then the operator must hold the CLEAR MEMORY key for 5 continuous seconds and then the top and bottom pointer in the EEPROM is reset, which mimics having all the data erased.

From the MAIN MENU if the operator pushes the RECORD key, the program branches to the RECORD routine. At the start of this routine, the MAIN MENU button of the keypad and the thermostat voltage are constantly monitored. In this routine, the program reads the presence or absence of a 24-volt signal from the thermostat connections of the gas burner primary control, after that voltage goes through the opto-isolator, U11 and the A/D, U9. The microprocessor takes 64 samples and averages them and determines whether they are greater or less than 2.5 volts. This is to flatten out any spikes. Less than 2.5 volts indicates that the thermostat is in an ON condition, and 2.5 or more volts indicates that the thermostat is in an OFF condition.

When the microprocessor detects that the thermostat is ON, the time is recorded in the EEPROM along with the message THERMOSTAT ON. The program then goes to another routine that is constantly monitoring the voltage arriving at the main gas valve, which is Channel 6 of the A/D converter, U9. At the same time it is still monitoring the thermostat and the keypad. If the voltage arriving at the main gas valve is turned on within 10 minutes of the thermostat going on, then it is recorded as GAS VALVE ON along with the time and voltage. If, within the ten minute period, the thermostat does not go off (i.e. voltage does not go above 2.5 volts), the main menu button is not pressed, nor does voltage arrive at the main gas valve, then the program branches to the FAULT DETECTED routine.

The FAULT DETECTED routine causes all further data recording to cease, a message to be displayed on the LCD, and a signal is sent through J4 to any connected downstream microprocessor indicating that a fault has been detected.

When the thermostat goes on and voltage arrives at the main gas valve, then the program branches to another routine that records the voltage arriving at the main gas valve and the vent stack temperature immediately, then every 2 seconds for the next 10 seconds and then every 5 seconds for the next 40 seconds, each of these times (either the 2 second interval or the 5 second interval) is called a data point. Between every reading, the voltage arriving at the main gas valve is constantly being monitored and the lowest voltage within that either 2 or 5 second period is then recorded. The subroutine uses the four lowest voltage readings, averages them, and uses that as the lowest voltage reading for the 2 or 5 second period. During this time, at either the 2 or the 5 second point, the resistance of the thermistor is read. 128 resistance readings are taken as fast as possible, then they are summed and an average is taken, which then becomes the resistance reading. The thermistor is a 100K ohm thermistor, which means that the input volt ranges from 0.5 volts to 4.5 volts, corresponding to a range of −30 degrees to 430 degrees F. at the surface of the vent stack pipe. The program takes this resistance reading and compares it to a lookup table contained in the EPROM to get the corresponding temperature values. At each data point the program also receives input from the auxiliary/pressure sensor assembly. That input is compared with the look-up table and a pressure is determined for each of the pressure sensors.

After the set of readings taken at the 50 second data point after the thermostat has gone on, the program branches to another routine that is watching for the thermostat to turn off or the voltage arriving at the main gas valve to turn off. If the voltage arriving at the main gas valve turns off first, then the program branches to a routine that waits for the thermostat to turn off. If the thermostat does not go off for 10 minutes, then a fault has been detected and the program branches to the FAULT DETECTED routine. If the thermostat does go off within 10 minutes, then the program returns to the top of the RECORD routine, which is waiting for the thermostat to go on.

During the RECORD routine, the LCD displays, real time, the time, the status of the thermostat, the voltage arriving at the main gas valve and the temperature on the outside of the vent stack pipe.

Figure 10A:
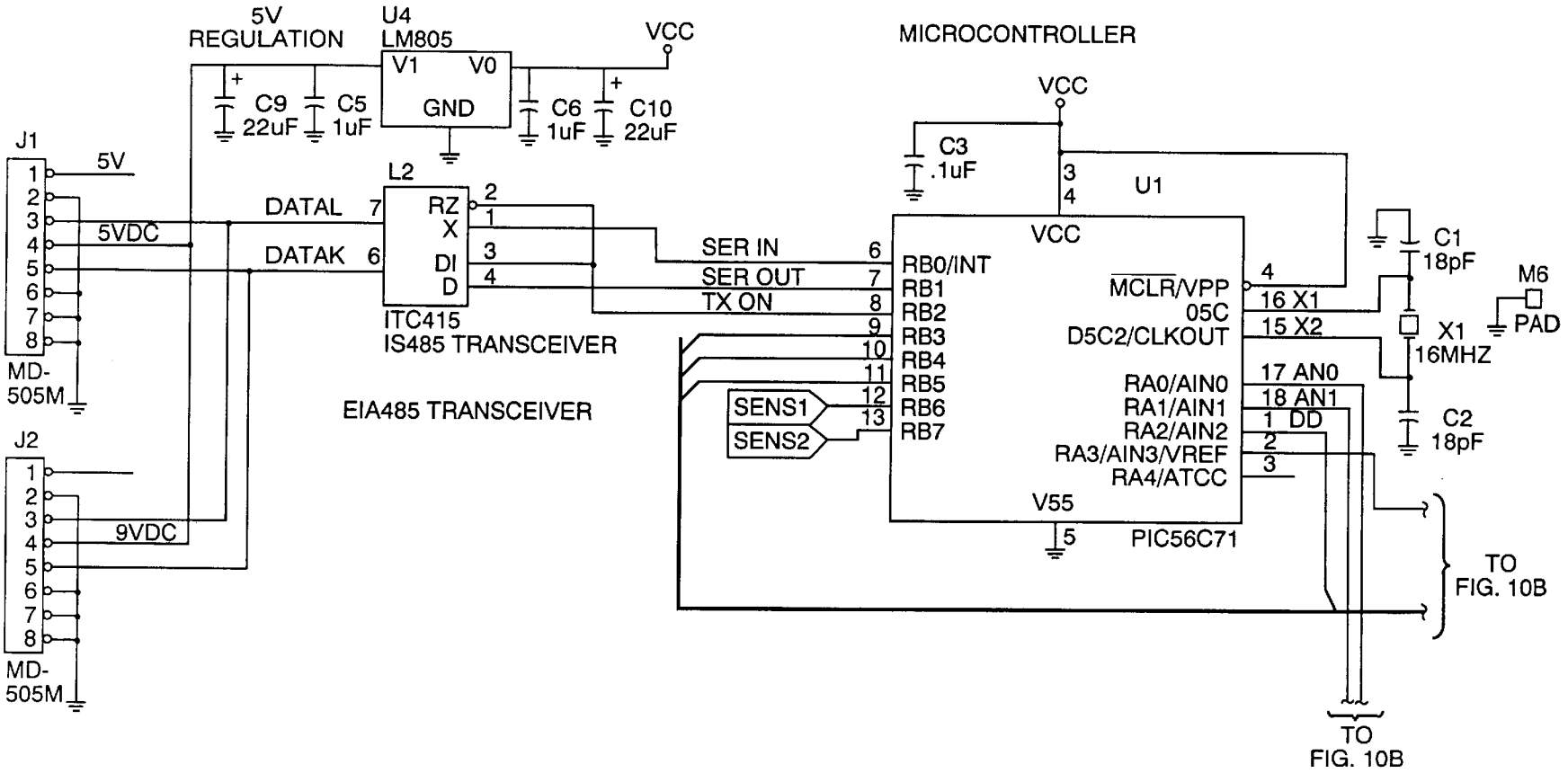
FIG. 10 is a schematic of the auxiliary board of the apparatus.
Figure 10B:
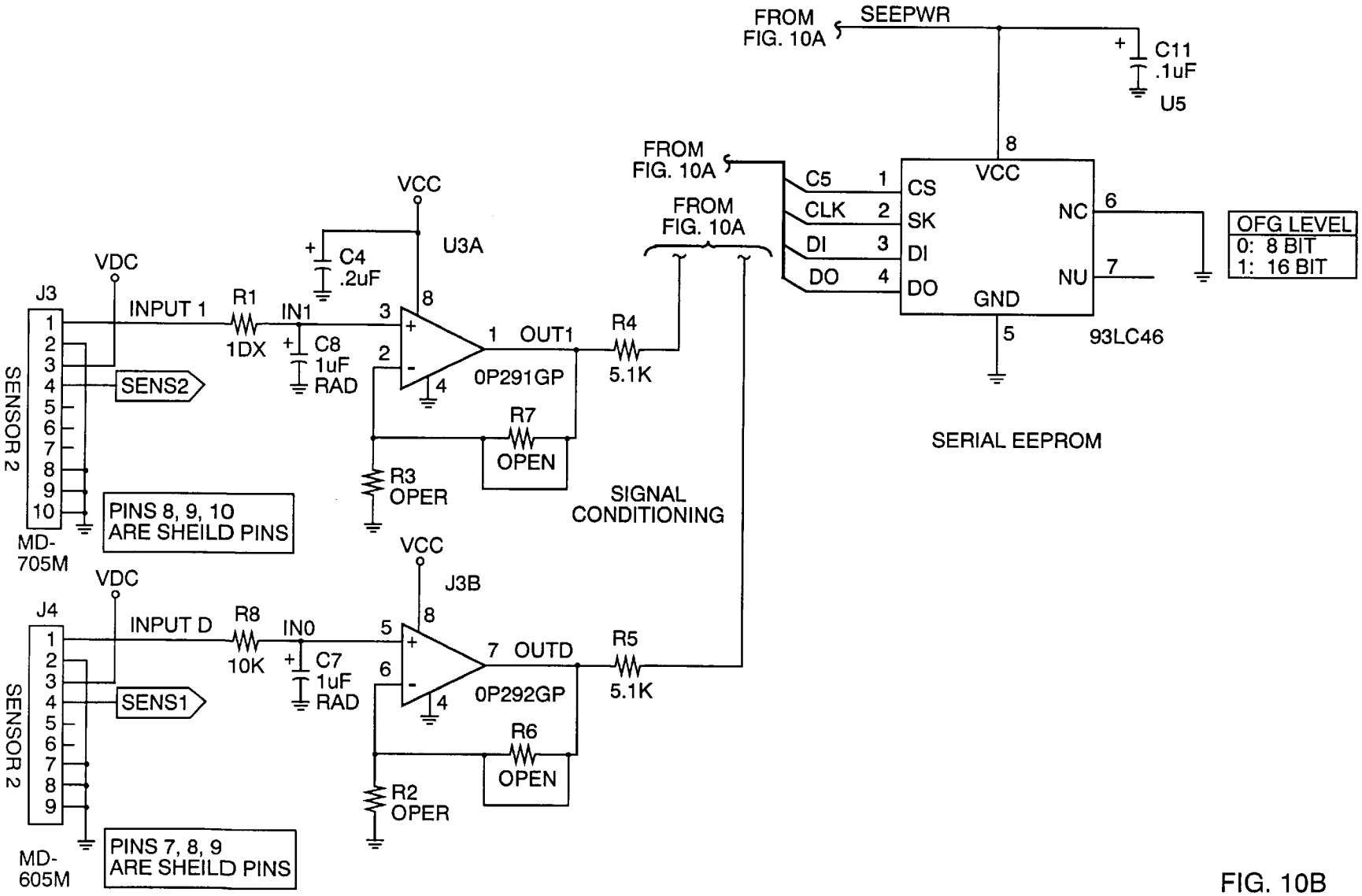

FIG. 10 is a block diagram of a typical gas burner showing the data logging apparatus either permanently mounted on or integral with the burner and a separate portable reader apparatus. In this embodiment, data collection unit 104 can be constructed as part of the gas burner 102 at the time of manufacture or it can be added later and permanently attached thereto. Gas burner 102 is typical of the type that is used with the invention. Combustion chamber 120 burns the fuel supplied to the burner 102 via fuel line 124 and to the main gas valve 122. Combustion gases exit via flue 128. The main gas valve 122 feeds the fuel/air mixture to combustion chamber 120 where it is ignited via igniter 118. Control system 116 determines when heat is required by thermostat 110 which then activates igniter 118 and the main gas valve 122. Electrical power is supplied to control system 116 via AC source 126.

As discussed above, the invention measures and stores data from four inputs which are connected to specific locations on gas burner 102. Connection 130 monitors activation and deactivation of the gas burner 102 primary control by the thermostat 110 and records the event with the time into EEPROM. Connection 130 monitors the presence or absence of 24 or more volts AC at the thermostat connections 112 of the gas burner primary control system 116.

Connection 132 monitors the activation and deactivation of the igniter 118 through connection to the ignition transformer activated by the gas burner primary control system 116 and records the event with the time into RAM located within data collection unit 104. As noted above, this is done by measuring the presence or absence of AC voltage at the secondary terminals of a 24 to 3.3 volt step-down transformer that will be connected to the primary wires of the main gas valve.

The third monitor, connection 134, is a thermistor attached to the outside of the vent stack 128 of the gas burner 102.

The fourth monitor receives data from the auxiliary/pressure sensor assembly which is connected to the pressure sensor located at the inlet of the main gas valve, and pressure sensor located at the outlet of the main gas valve.

In order to read the data collected by data collection unit 104, a technician merely connects data reading unit 106 to data collection unit 104 via line 136. Then, the technician is able to quickly and accurately diagnose the operational characteristics of gas burner 102 as noted above.

While there have been described what are presently considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A monitor and diagnostic apparatus for a gas burner, with said gas burner having a thermostat, a main gas valve, a vent stack and measurable performance indicators and said gas burner also having an operational history comprising a sequence of on/off cycles and performance events within each on/off cycle, said apparatus comprising:

a data recording unit comprising:

a sensor having a signal indicating one of said performance events by measuring at least one of said performance indicators;

a central processor which processes said signal from said sensor, said central processor having an output of at least one signal corresponding to the performance event of said gas burner over a pre-selected time interval;

a memory which records the output of said central processor over the pre-selected time interval in the sequential order and timing corresponding to the performance events and sequence having occurred in said gas burner;

wherein, said pre-selected time interval extends over a plurality of on/off cycles such that said recorded output from said central processor can be used to diagnose the operational history of said gas burner.

2. The monitor and diagnostic apparatus of claim 1 further comprising:

a first voltage sensor connectable to the thermostat of said gas burner.

3. The monitor and diagnostic apparatus of claim 1 further comprising:

a second voltage sensor connectable to the main gas valve of said gas burner.

4. The monitor and diagnostic apparatus of claim 3 wherein said second voltage sensor further comprises:

a step down assembly for stepping down the voltage arriving at the main gas valve of said gas burner to a voltage below a threshold that could cause injury to a human.

5. The monitor and diagnostic apparatus of claim 1 further comprising:

a temperature sensor connectable to the vent stack of said gas burner.

6. The monitor and diagnostic apparatus of claim 1 further comprising:

a first pressure sensor connectable to the inlet of said gas valve of said gas burner.

7. The monitor and diagnostic apparatus of claim 1 further comprising:

a second pressure sensor connectable to the outlet of said gas valve of said gas burner.

8. The monitor and diagnostic apparatus of claim 1 further comprising a portable data reading unit comprising:

a display which displays said recorded output of said memory such that an operator of said apparatus can visually determine the operational history of said gas burner over the pre-selected time interval.

9. The monitor and diagnostic apparatus of claim 8 wherein said portable data reading unit further comprises:

a keypad which can access said recorded output stored in said memory wherein the operator of said apparatus can review the sequence of performance events that has occurred over the pre-selected time interval.

10. The monitor and diagnostic apparatus of claim 1 wherein said central processor processes said signal to provide a fault indicator signal and a time of occurrence if one of the performance events of said gas burner during the pre-selected time interval results in a fault condition within said gas burner.

11. The monitor and diagnostic apparatus of claim 10 further comprising:

a fault detector, activated by the fault indicator signal, wherein said fault indicator signal ceases operation of said memory and provides a fault alarm output signal that indicates to a downstream microprocessor that a fault has occurred.

12. The monitor and diagnostic apparatus of claim 1 further comprising:

a voltage sensor connectable to the thermostat of said gas burner, said voltage sensor having a first signal corresponding to the voltage at the thermostat of said gas burner;

a pressure sensor connectable to the outlet of said gas valve of said gas burner, said pressure sensor having a second signal corresponding to the gas pressure downstream of the main gas valve of said gas burner;

wherein said central processor compares whether said second signal occurs within a preselected time upon the detection of said first signal wherein if said second signal is not detected, said central processor provides a fault indicator signal.

* * * * *